US006749694B2

(12) United States Patent
Greene et al.

(10) Patent No.: US 6,749,694 B2
(45) Date of Patent: Jun. 15, 2004

(54) CONVERSION COATINGS INCLUDING ALKALINE EARTH METAL FLUORIDE COMPLEXES

(75) Inventors: Jeffrey Allen Greene, Warren, MI (US); Donald Robb Vonk, Clinton Township, MI (US)

(73) Assignee: PPG Industries Ohio, Inc., Cleveland, OH (US)

( * ) Notice: Subject to any disclaimer, the term of this patent is extended or adjusted under 35 U.S.C. 154(b) by 94 days.

(21) Appl. No.: 10/134,761

(22) Filed: Apr. 29, 2002

(65) Prior Publication Data

US 2003/0205299 A1 Nov. 6, 2003

(51) Int. Cl.[7] ..... C23C 22/00

(52) U.S. Cl. ..... 148/243; 148/247; 148/273; 148/279; 106/14.11; 106/14.21; 252/387

(58) Field of Search ..... 148/243, 247, 148/273, 279; 106/14.11, 14.21; 252/387

(56) References Cited

U.S. PATENT DOCUMENTS

| | | | | |
|---|---|---|---|---|
| 4,338,140 | A | 7/1982 | Reghi | 148/6.14 R |
| 4,457,790 | A | 7/1984 | Lindert et al. | 148/6.15 R |
| 4,728,456 | A | 3/1988 | Yamasoe et al. | 252/142 |
| 4,886,616 | A | 12/1989 | Yamasoe et al. | 252/142 |
| 5,294,226 | A | 3/1994 | Chow | 411/338 |
| 5,380,374 | A | 1/1995 | Tomlinson | 148/247 |
| 5,441,580 | A | 8/1995 | Tomlinson | 148/247 |
| 5,646,211 | A | 7/1997 | Honda et al. | 524/406 |
| 5,759,244 | A | 6/1998 | Tomlinson | 106/14.14 |
| 5,952,049 | A | 9/1999 | Tomlinson | 427/327 |
| 5,964,928 | A | 10/1999 | Tomlinson | 106/14.21 |
| 6,312,812 | B1 | 11/2001 | Hauser et al. | 428/412 |
| 6,524,403 | B1 * | 2/2003 | Bartlett et al. | 148/247 |

FOREIGN PATENT DOCUMENTS

| | | |
|---|---|---|
| EP | 0459550 | 4/1991 |
| EP | 0645473 | 8/1994 |
| WO | 97/02369 | 1/1997 |

* cited by examiner

*Primary Examiner*—Andrew L. Oltmans
(74) *Attorney, Agent, or Firm*—Deborah M. Altman

(57) ABSTRACT

An aqueous composition for pretreating and depositing a coating on metal substrates is provided. The coating composition includes from about 1,500 to about 55,000 ppm based on the aqueous composition of a Group IIA dissolved metal ion, from about 100 to about 200,000 ppm based on the aqueous composition of a dissolved complex metal fluoride ion wherein the metal atom is selected from Group IIIA, Group IVA, Group IVB metals, Group VA, Group VB metals; and water. The composition is substantially free of Group IIA metal fluoride precipitate. This is desirably achieved by including in the aqueous composition a complex metal salt which is different than the salt associated with the complex metal fluoride ion, with the complex metal salt being capable of complexing free fluoride ions to prevent a precipitation reaction with the Group IIA metal ion. A method of preparing such an aqueous coating composition is further provided.

9 Claims, No Drawings

CONVERSION COATINGS INCLUDING ALKALINE EARTH METAL FLUORIDE COMPLEXES

FIELD OF THE INVENTION

The present invention relates to coating compositions for pretreating metal surfaces. More particularly, the present invention is directed to aqueous coating compositions for providing durable, adhesive and corrosion-inhibiting coatings, as well as a method for pretreating metal surfaces with such coating compositions.

BACKGROUND OF THE INVENTION

The use of protective coatings on metal surfaces for improved corrosion resistance and paint adhesion characteristics is well known in the metal finishing arts. Conventional techniques involve pretreating metal substrates with a phosphate conversion coating and chrome-containing rinses for promoting corrosion resistance. The use of such chromate-containing compositions, however, imparts environmental and health concerns due to the toxic nature associated with chromium compounds.

As a result, chromate-free conversion coatings have been developed to overcome the need for chromate-containing compositions. Such chromate-free coatings are generally based on chemical mixtures that in some way will react with the substrate surface and bind to it to form protective layers.

Chromate-free conversion coatings typically employ a Group IVB metal such as titanium, zirconium or hafnium, a source of fluoride ion and a mineral acid to regulate the pH.

For example, U.S. Pat. No. 4,338,140 to Reghi discloses a conversion coating for improved corrosion resistance which includes zirconium, fluoride, and tannin compounds, and optionally phosphate ions. U.S. Pat. No. 5,759,244 discloses conversion coatings for metal substrates including a Group IVB metal in an acidic solution with one or more oxyanions, and which specifically excludes fluoride ions from the composition.

It has been suggested to include Group IA and/or Group IIA elements into such conversion coatings. For example, U.S. Pat. No. 5,441,580 to Tomlinson discloses the use of a Group IVB metal such as titanium, zirconium or hafnium, and Group IA metal such as potassium, and a source of fluoride ions, and U.S. Pat. No. 5,380,374 to Tomlinson discloses coatings based on such Group IVB metals including a Group IIA metal such as calcium at a concentration of 50 ppm to 1300 ppm. As is recognized in the art, for example in U.S. Pat. No. 5,964,928 to Tomlinson, coatings including Group IIA metals such as calcium generate considerable scaling from alkali metal precipitates, which may inhibit formation of the continuous metal oxide matrix. Such Group IIA metals are therefore generally used in lower concentrations. Also, as recognized in the U.S. Pat. No. 5,964,928, such compositions including Group IA or Group IIA metals likely provide little if any long-range structure.

Accordingly, it would be desirable to provide a composition useful for coating metal substrates, particularly bare ferrous metals, which overcomes the environmental drawbacks of the prior art, which demonstrates excellent corrosion resistance and adherence of subsequently applied coatings, and which does not form a precipitate which may interfere with proper formation of the coating.

SUMMARY OF THE INVENTION

In accordance with the present invention, an aqueous composition for pretreating and depositing a coating on metal substrates is provided, which includes from about 1,500 to about 55,000 ppm based on the aqueous composition, of a Group IIA dissolved metal ion, such as calcium; from about 100 to about 200,000 ppm based on the aqueous composition, of a dissolved complex metal fluoride ion wherein the central atom is selected from Group IIIA, Group IVA, Group IVB, Group VA, and Group VB metals such as aluminum, silicon, zirconium, antimony, and niobium; and water, wherein the composition is substantially free of Group IIA metal fluoride precipitate. The aqueous composition desirably contains a complex-forming metal compound, such as a complex metal salt, which is different than the salt associated with the complex metal fluoride ion, with the complex metal salt being capable of complexing free fluoride ions to prevent a precipitation reaction with the Group IIA metal ion. The metal atom of the complex metal salt is desirably selected from zirconium and silicon, such as sodium metasilicate, polysilicate, Zeolites (aluminosilicates), zirconyl nitrate, titanyl sulfate, tetrafluorozirconate and tetrafluorotitanate.

In a further embodiment, the present invention includes a method of preparing an aqueous composition for treating metal substrates, which includes adding to water a complex metal fluoride compound wherein the central atom is selected from Group IIIA, Group IVA, Group IVB, Group VA and Group VB metals; adding a complex metal salt different from the complex metal fluoride compound in an amount capable of reacting with any free fluoride ions from the complex metal fluoride compound; and adding a Group IIA metal compound. The composition is substantially free of precipitated Group IIA metal fluoride.

Desirably, the Group IIA metal compound is provided in an amount of from about 2.0 to 10.0 g/L based on the aqueous composition, the complex metal fluoride compound is added in an amount of from about 1.0 to 80 g/L based on the aqueous composition, and the complex metal salt is added in an amount of from about 0.05 to about 6.0 g/L based on the aqueous composition.

DETAILED DESCRIPTION OF THE INVENTION

Other than in the operating examples, or where otherwise indicated, all numbers expressing quantities of ingredients or reaction conditions used in the specification and claims are to be understood as modified in all instances by the term "about".

As indicated, the present invention is directed to aqueous compositions for pretreating and depositing crystalline and non-crystalline coatings on metal substrates. The compositions of the present invention may be utilized to improve the corrosion-inhibiting properties of metal surfaces such as iron, steel, zinc, magnesium, or aluminum, or their alloys. The compositions of the present invention can be used to replace conventional metal treatments such as iron phosphate, zinc phosphate and chromium conversion coatings.

In one embodiment of the invention, the aqueous coating composition includes a Group IIA dissolved metal ion, a dissolved complex metal fluoride ion with the central atom selected from selected from Group IIIA, Group IVA, Group IVB, Group VA, and Group VB metals, and water. The composition according to the present invention is substantially free of Group IIA metal fluoride precipitate.

The Group IIA dissolved metal ions referred to herein are those elements included in such group in the CAS Periodic Table of the Elements as is shown, for example, in the

*Handbook of Chemistry and Physics*, 63rd Edition (1983). The Group IIA metal is, in particular, an alkaline earth metal. For example, the Group IIA metal may be calcium, magnesium, beryllium, strontium or barium. Calcium is particularly useful in connection with the present invention. The Group IIA metal may be provided from any compound or composition which is easily dissolved in the aqueous composition to provide a source of Group IIA metal ion. In particular, the Group IIA metal may be provided as any of the many inorganic hydroxides or salts available, including the nitrates, sulfates, chlorides, etc. Calcium hydroxide [$Ca(OH)_2$], calcium nitrate [$Ca(NO_3)_2$], etc. are particularly useful, with calcium nitrate being particularly desirable in connection with the present invention.

The composition of the present invention further includes at least one metal compound which is capable of converting to a metal oxide upon application to the metal substrate. The metal compound which is the precursor of the formation of the metal oxide on the surface of the substrate can be any metal compound capable of converting to a metal oxide. For example, the metal compound may be selected from those elements included in Groups IIIA, IVA, IVB, VA, VB, and VIB of the CAS Periodic Table of the Elements. Examples of such useful metal compounds include silicon, boron, aluminum and tin. Additionally, the metal compound may be selected from nickel, manganese, iron and thorium, for example through the use of complex fluoride metal anions such as $NiF_6$, $MnF_6$, $FeF_4$ and $ThF_6$.

Desirably, a metal compound is selected from the Group IVA and/or Group IVB transition metals of the CAS Periodic Table of the Elements, such as those selected from the group consisting of silicon, titanium, zirconium and hafnium ions and mixtures thereof. The Group IVA and/or Group IVB metal is provided in ionic form, which is easily dissolved in the aqueous composition. The metal ions may be provided by the addition of specific compounds of the metals, such as their soluble acids and salts.

A source of fluoride ion is also included to maintain the solubility of the metals in solution. The fluoride may be added as an acid or as a fluoride salt. In particularly desirable embodiments, the metal compound is a complex metal fluoride ion, which is provided as a fluoride acid or salt of the metal. As such, the complex metal fluoride ion provides both a Group IVA and/or Group IVB metal as well as a source of fluoride to the composition. Examples of useful compositions include fluorosilicic acid, fluorozirconic acid, fluorotitanic acid, ammonium and alkali metal fluorosilicates, fluorozirconates and fluorotitanates, zirconium fluoride, and the like. Hexafluorosilicate, hexafluorozirconate, and hexafluorotitanate are particularly useful compounds.

As indicated, the pretreatment compositions of the present invention are provided as an aqueous solution. The balance of the composition, therefore comprises water. The Group IIA dissolved metal ion is present in the aqueous solution of the present invention in an amount of from about 1,500 ppm to about 55,000 ppm, preferably in an amount of from about 2,000 ppm to about 10,000 ppm. The Group IVB dissolved complex metal fluoride ion is present in the aqueous solution of the present invention in an amount of from about 100 ppm to about 200,000 ppm, preferably in an amount of from about 1,000 ppm to about 80,000 ppm.

As noted above, conversion coating compositions including Group IIA dissolved metal ions such as calcium with Group IVA and/or Group IVB complex metal compounds typically form alkali metal precipitates, which are deleterious to the coating composition. In particular, the alkaline earth metal such as calcium will typically react with excess fluoride or free fluoride ions of the complex metal fluoride ion dissolved in the aqueous solution. The Group IIA metal ion, however, imparts significant advantages to the coating composition in terms of its properties, and in particular corrosion resistance. It has been unexpectedly discovered through the present invention that conversion coating compositions can be prepared including Group IIA metal ions at higher concentrations, therefore imparting excellent properties to the composition, which coating compositions are substantially free from any Group IIA metal fluoride precipitate, which may deleteriously affect the composition.

In order to prevent such precipitation, the aqueous composition of the present invention may further include a compound which is capable of forming complex ions with any available uncomplexed fluoride ions, i.e., a complex forming metal compound such as a complex metal salt. It has been unexpectedly discovered that such a complex forming metal compound is capable of complexing free fluoride ions, and in particular free fluoride ions of the complex metal fluoride ion dissolved in the aqueous solution. By complexing such free fluoride ions, there is no excess fluoride ion dissolved in the aqueous composition for reaction with the alkaline earth metal. As such, a precipitation reaction between the Group IIA alkaline earth metal ion and any excess or free fluoride is prevented. The complex forming metal compound is desirably a complex metal salt, which is different from the Group IVB complex metal fluoride ion and different from any salt associated with the Group IVB complex metal fluoride ion.

The metal atom of the complex forming metal compound is desirably selected from the group consisting of zirconium and silicon. For example, the complexing metal may be selected from the group consisting of sodium metasilicate, polysilicate, Zeolites (aluminosilicates), zirconyl nitrate, titanyl sulfate, tetrafluorozirconate, tetrafluorotitanate. The complex forming metal compound provides the aqueous coating composition with excess metal which acts as a scavenger for the free fluoride ions present in the solutions that are used to supply the complex metal ions. In order to provide effective complexing of such free fluoride ions, the complex forming metal compound is desirably added to the solution of the aqueous coating composition prior to adding the Group IIA alkaline earth metal ion, as will be discussed in more detail with reference to the method of preparing the coating composition.

The complex forming metal compound is provided in the aqueous solution of the present invention in an amount which is capable of providing excess metal for complexing any free fluoride that is supplied by the composition containing the Group IVA and/or Group IVB complex metal fluoride salts. Desirably, the complex forming metal compound is provided in an amount of from about 50 ppm to about 6,000 ppm, preferably in an amount of from about 100 ppm to about 2,000 ppm.

In addition, the aqueous coating composition of the present invention may also contain ferrous or ferric ions in amounts of up to about 250 to 2000 ppm. When the aqueous coating compositions of the present invention are to be utilized to coat non-ferrous surfaces such as zinc-coated surfaces, ferrous or ferric ions may be added to the coating composition. Water-soluble forms of iron can be utilized as a source of the ferrous or ferric ions, and such compounds include ferrous phosphate, ferrous nitrate, ferrous sulfate, etc. When the surface to be coated is an iron surface, it may not be necessary to add any or as much ferrous or ferric ions since a portion of the iron surface is dissolved into the coating composition upon contact.

The aqueous coating compositions of the present invention generally are utilized at a pH of between about 0 to 5.0, more preferably at a pH of about 1.0 to about 5.0 depending on the method of application. More particularly, the composition may be generally maintained at a pH range of from about 1.0 to about 3.5 for use in immersion and spray applications, and at a pH range of from about 0 to about 2.0 for use in physical applications such as rollers, brushes, and the like. The pH of the solution can be adjusted by the addition of an alkali such as sodium hydroxide, potassium hydroxide, ammonium hydroxide, or sodium carbonate to increase the pH, or an acid such as a mineral acid, for example nitric acid or phosphoric acid, to reduce the pH of the composition.

The coating compositions of the present invention can be applied to substrate surfaces in any known manner, for example, by immersion, dip coating, roll coating, spraying, and the like, as well as any combination of these methods.

The present invention further provides a method of preparing the aqueous composition for treating metal substrates. In the method, the Group IVA and/or Group IVB complex metal fluoride compound as described above is added to and dissolved in an amount of water, in sufficient quantity to provide the solution with a concentration of about 100 to about 200,000 ppm of complex metal fluoride ion. Desirably, the complex metal fluoride compound is added in an amount of from about 1 to about 80 grams per liter (g/L) based on the aqueous composition.

After the complex metal fluoride compound has been added and dissolved in the water, a complex forming metal compound which is different from the complex metal fluoride compound, as described above, is added to and dissolved in the solution. The complex forming metal compound is provided in an amount which is capable of reacting and complexing with any free fluoride ions from the complex metal fluoride compound. Desirably, the complex forming metal compound is provided as a complex metal salt which is added in an amount of from about 0.1 to about 2.0 g/L based on the aqueous composition.

The Group IIA metal compound as discussed above is then added and dissolved in the solution, in an amount sufficient to provide the solution with a concentration of about 1,500 to about 55,000 ppm of Group IIA dissolved metal ion. Desirably, an amount of from about 1.5 to about 55 grams per liter (g/L) based on the aqueous composition of the Group IIA metal ion will provide such a concentration.

By adding the complex forming metal compound to the solution prior to the Group IIA metal compound, any free fluoride from the complex metal fluoride compound will be complexed by the complex forming metal compound. As such, the solution does not include any free fluoride for reaction with the alkaline earth metal of the Group IIA metal compound, thereby preventing any precipitation reaction. As such, the composition is substantially free of precipitated Group IIA metal fluoride.

During the preparation of such composition, the pH of the solution may be adjusted with known compositions as set forth above, during any step of preparation. Desirably, the pH of the solution is adjusted prior to addition of the Group IIA alkaline earth metal ion. This may be accomplished through the addition of a mineral acid such as nitric acid.

The present invention will further be described in terms of a method of treating a metal substrate with the inorganic conversion coating compositions as described above. The substrate to be coated is usually first cleaned to remove grease, dirt, or other extraneous matter. This is done by employing conventional cleaning procedures and materials. These would include mild or strong alkaline cleaners such as are commercially available and conventionally used in metal pretreatment processes. Examples of alkaline cleaners include Chemkleen 163 and Chemkleen 177, both of which are available from PPG Industries, Pretreatment and Specialty Products. Such cleaners are generally followed and/or preceded by a water rinse.

Following the optional cleaning step, the metal surface may further be treated with a surface activating agent for promoting the formation and deposition of a crystallized coating. For example, the metal surface may be treated with metal oxide strippers, etch promoters, crystallization initiators, and the like. Examples of useful compositions include fluoride containing deoxidizing solutions, acidic or alkaline pickling baths, Jernstedt salt activator solutions, and the like.

Also useful are agents that alter the rate of crystal formation of the coatings, for example by promoting metal surface oxidation or depolarization. Examples of compositions useful in this regard including hydroxylamine salts and their organic derivatives, sodium nitrite, organic nitro compounds, organic and inorganic peroxy compounds, chlorates, bromates, permanganates, and the like.

Following the optional cleaning and pretreatment surface activation steps, the metal surface is contacted with the aqueous coating composition as set forth above. In particular, the metal surface is contacted with the aqueous solution or dispersion of the coating composition, which includes the Group IIA dissolved metal ion, the Group IVA and/or Group IVB dissolved complex metal fluoride ion and the complex forming metal salt, in water. The aqueous solution or dispersion may be applied to the metal substrate by known application techniques as noted above, such as by immersion, dip coating, roll coating, spraying, and the like, or combinations of these techniques, such as dipping followed by spraying or spraying followed by dipping. Typically, the aqueous solution or dispersion is applied to the metal substrate at solution or dispersion temperatures ranging from ambient to about 150° F. (ambient to 65° C.), and preferably at ambient temperatures. The contact time is generally between 10 seconds and five minutes, preferably 30 seconds to 2 minutes, when dipping the metal substrate in the aqueous medium or when the aqueous medium is sprayed onto the metal substrate.

The coating weight of the pretreatment coating composition generally ranges from about 1 to about 23,600 milligrams per square meter ($mg/m^2$), and is preferably about 10 to about 3000 $mg/m^2$.

After contact with the aqueous coating composition, the substrate may be rinsed with deionized water, and may further involve an organic or inorganic post rinse or sealer, such as a chromate or non-chromate sealer, or an epoxy resin rinse, as is generally known in the art.

For example, the substrate may be treated with an epoxy resin composition such as that disclosed in U.S. Pat. No. 6,312,812.

As noted above, it has been unexpectedly recognized through the present invention that conversion coating compositions can be used for imparting excellent properties to the composition such as corrosion resistance, even when the compositions include Group IIA metal ions at high concentrations. It has been discovered that such high levels of Group IIA metal ions, and in particular calcium, can provide coating compositions which are substantially free from any Group IIA metal fluoride precipitate, particularly when the coating solutions include a free fluoride scavenger. Such coating compositions provide excellent results when applied to metal substrates, and can be particularly useful even at reduced exposure time with the metal substrate. As such, higher alkaline earth metal concentrations can be used for better corrosion resistance with shorter application times, without presenting precipitation problems which may deleteriously affect the coating composition.

The following examples demonstrate the preparation of coating compositions of the present invention, as well as comparisons of such coatings with prior art compositions. Unless otherwise indicated in the examples and elsewhere in the specification and claims, all parts and percentages are by weight, temperatures are in degrees Centigrade, and pressures are at or near atmospheric pressure.

EXAMPLES

Example 1

Example 1 represents a comparative example, demonstrating a conversion coating prepared in accordance with Example 1 of U.S. Pat. No. 5,441,580, including 15 g/L potassium hexafluorozirconate in distilled water, with 0.10 g $H_3BO_3$, 5 g $KF.2H_2O$, 60 ml HF, providing approximately 4876 ppm Zr.

Example 2

Example 2 represents a comparative example, demonstrating a conversion coating prepared in accordance with Example 2 of U.S. Pat. No. 5,380,374, including 1 g/L potassium hexafluorozirconate in distilled water with 148 mg calcium hydroxide and nitric acid, providing approximately 313 ppm Zr, 402 ppm F, and 80 ppm Ca.

The compositions of Example 2 and 3 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 1.

TABLE 1

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 1 | 11.8 | 19.3 | 8.0 | 14.8 |
| 2 | 9.1 | 13.0 | 7.2 | 13.7 |

Example 3

Example 3 represents a comparative example, demonstrating a coating solution prepared with a complex metal fluoride ion, and with calcium ions in the composition in an amount greater than 1,500 ppm, without a complex-forming metal salt.

A solution was prepared in deionized water as follows: Hexafluorozirconic acid (2.25 grams $H_2ZrF_6$ per liter, providing approximately 990 ppm Zr and approximately 1200 ppm F) was added to a solution containing calcium nitrate and nitric acid (2500 ppm Ca). The pH was adjusted to 2.0 with nitric acid.

A white precipitate formed as the hexafluorozirconic acid was added to the calcium solution. This precipitate consisted of calcium, zirconium, and fluoride.

Example 4

Example 4 represents a further comparative example, demonstrating a coating solution prepared with a complex metal fluoride ion, and with calcium ions in the composition in an amount greater than 1,500 ppm, without a complex-forming metal salt, with the coating prepared according to a different procedure than Example 3.

A solution was prepared in deionized water as follows: Hexafluorozirconic acid was added to distilled water (2.25 grams $H_2ZrF_6$ per liter, providing approximately 990 ppm Zr and approximately 1200 ppm F) and nitric acid was added to adjust the pH=2.0. Calcium nitrate(s) was added to this mixture (10 g per liter $Ca(NO_3)_2$ providing approximately 2,500 ppm Ca).

A white precipitate formed as the calcium nitrate dissolved in the solution. This precipitate consisted of calcium, zirconium, and fluoride.

Example 5

Example 5 represents a comparative example demonstrating a coating solution prepared with a complex metal fluoride ion, and with metal salt different from the complex metal fluoride ion, but without any calcium ions.

A solution was prepared in deionized water as follows: The following ingredients were mixed in the order listed below to provide a stable solution with a pH=2.0.

| | | |
|---|---|---|
| 2.25 g/l | hexafluorozirconic acid | (approx. 990 ppm Zr, 1200 ppm F) |
| 27.5 g/l | nitric acid (42 Be) | (approx. 18,000 ppm $NO_3$) |
| 1.0 g/l | Advera 401 (aluminosilicate - zeolite) | |
| | ammonium hydroxide (28%) | |

Example 6

Example 6 demonstrates a conversion coating prepared in accordance with the present invention, including hexafluorozirconic acid as a complex metal fluoride ion, calcium nitrate, and with sodium metasilicate as a complex forming metal salt.

A conversion coating solution was prepared in deionized water as follows:

The following ingredients were mixed in the order listed below to provide a stable solution with a pH=2.0.

| | | |
|---|---|---|
| 5.5 g/l | sodium metasilicate | |
| 6.0 g/l | nitric acid (42 Be) | |
| 2.25 g/l | hexafluorozirconic acid | (approx. 990 ppm Zr, 1200 ppm F) |
| 10.0 g/l | calcium nitrate | (approximately 2,500 ppm Ca) |

Example 7

Example 7 demonstrates a conversion coating prepared in accordance with the present invention including sodium hexafluorostannate (IV) as a complex metal fluoride ion, calcium nitrate, and with sodium metasilicate pentahydrate as a complex forming metal salt.

A conversion coating solution was prepared in deionized water as follows:

The following ingredients were mixed in the order listed below to provide a stable solution with a pH=1.3:

| | | |
|---|---|---|
| 3.0 g/l | sodium metasilicate petahydrate | (approx. 1000 ppm $SiO_3$ as stabilizer) |
| 1.62 g/l | sodium hexafluorostannate (IV) | (approx. 1300 ppm $SnF_6$ as primary coating anion) |
| 5.2 g/l | nitric acid (42 Be) | |
| 8.75 g/l | calcium nitrate | (approx. 1700 ppm Ca) |

Examples 8–14 demonstrate various conversion coatings prepared in accordance with the present invention, including varying concentrations of calcium ions in combination with a complex metal fluoride ion including zirconium as the metal atom, and aluminosilicate zeolite as a complex forming metal salt.

Example 8

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 10.25 g/l | calcium nitrate | (approx. 2500 ppm Ca) |

Example 9

A conversion coating solution was prepared in deionized water as follows:

The following ingredients were mixed in the order listed below to provide a stable solution with a pH=3.0.

| | | |
|---|---|---|
| 0.5 g/l | Advera 401 (aluminosilicate - zeolite) | |

-continued

| | | |
|---|---|---|
| 2.25 g/l | hexafluorozirconic acid | (approx. 990 ppm Zr, 1200 ppm F) |
| 10.25 g/l | calcium nitrate | (approx. 2500 ppm Ca) |

Example 10

A conversion coating solution was prepared in deionized water as follows:

The following ingredients were mixed in the order listed below to provide a stable solution with a pH=2.0.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 16.2 g/l | calcium nitrate | (approx. 4000 ppm Ca) |

Example 11

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.0 g/l | calcium nitrate | (approx. 4900 ppm Ca) |

Example 12

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |

Example 13

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |

-continued

| | | |
|---|---|---|
| 2.25 g/l | hexafluorozirconic acid | (approx. 990 ppm Zr, 1200 ppm F) |
| 20.5 g/l | calcium nitrate | (approx. 5000 ppm Ca) |

Example 14

A conversion coating solution was prepared in deionized water as follows:

The following ingredients were mixed in the order listed below to provide a stable solution with a pH=2.0.

| | | |
|---|---|---|
| 1.0 g/l | Advera 401 (aluminosilicate - zeolite) | |
| 4.2 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) (approx. 18,000 ppm $NO_3$) |

Examples 15–19 demonstrate various conversion coatings prepared in accordance with the present invention, including varying concentrations of calcium ions in combination with a complex metal fluoride ion including zirconium as the metal atom, aluminosilicate zeolite as a complex forming metal salt, and with a further component in the composition.

Example 15

A conversion coating solution was prepared in deionized water as follows:

The following ingredients were mixed in the order listed below to provide a stable solution with a pH=2.0.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |
| 0.5 g/l | Dowfax 2A1 | |

Example 16

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |
| 0.1 g/l | tin(II) chloride, dihydrate | (approx. 50 ppm Sn) |

Example 17

A conversion coating solution was prepared in deionized water as follows:

The following ingredients were mixed in the order listed below to provide a stable solution with a pH=2.0.

| | | |
|---|---|---|
| 0.375 g/l | sodium metasilicate | |
| 0.125 g/l | Advera 401 (aluminosilicate - zeolite) | |
| 2.0 g/l | nitric acid (42 Be) | |
| 1.125 g/l | hexafluorozirconic acid | (approx. 495 ppm Zr, 600 ppm F) |
| 10.25 g/l | calcium nitrate | (approx. 2500 ppm Ca) |

Example 18

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |
| 10.0 ml/l | Chemseal 77 | |
| 0.5 g/l | ammonium bifluoride | (approx. 300 ppm F) |

Example 19

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |
| 10.0 ml/l | Chemseal 77 | |

Example 20

A conversion coating solution was prepared in deionized water as follows:

The following ingredients were mixed in the order listed below to provide a stable solution with a pH=1.4.

| | | |
|---|---|---|
| 1.0 g/l | Advera 401 (aluminosilicate - zeolite added as stabilizer) | |
| 6.25 g/l | nitric acid (42 Be) | |
| 2.25 g/l | hexafluorozirconic acid | (approx. 990 ppm Zr, 1200 ppm F) |
| 8.0 g/l | calcium nitrate | (approx. 2000 ppm Ca) |
| 2.0 g/l | hydroxylamine sulfate | (approx. 800 ppm hydroxylamine added as accelerator) |
| 0.4 g/l | tin (II) chloride, dihydrate | (approx. 200 ppm Sn added as coating modifier) |

The compositions of Examples 5–20 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 2.

TABLE 2

SALT DIP PERFORMANCE (10 DAY)

| | COLD ROLLED STEEL | | ELECTRO-GALVANIZED | |
|---|---|---|---|---|
| EXAMPLE | AVG. CREEP (mm) | MAX. CREEP (mm) | AVG. CREEP (mm) | MAX. CREEP (mm) |
| 5 | PD* | PD* | 7.8 | 18.2 |
| 6 | 5.4 | 6.8 | 7.4 | 16.8 |
| 7 | 7.5 | 10.4 | 5.7 | 11.7 |
| 8 | 3.2 | 5.3 | 9.1 | 19.3 |
| 9 | 2.2 | 3.2 | 9.8 | 17.2 |
| 10 | 3.8 | 7.8 | 12.5 | 22.8 |
| 11 | 4.8 | 11.3 | 10.6 | 20.3 |
| 12 | 3.8 | 7.8 | 10.5 | 22.7 |
| 13 | 2.8 | 4.7 | 7.4 | 14.3 |
| 14 | 4.4 | 10.0 | 8.7 | 17.3 |
| 15 | 5.6 | 15.7 | 5.5 | 12.3 |
| 16 | 4.2 | 9.7 | 7.8 | 15 |
| 17 | 5.5 | 10.7 | 9.5 | 15.3 |
| 18 | 3.4 | 6.8 | 12.6 | 29.8 |
| 19 | 2.7 | 4.3 | 18.0 | 32.3 |
| 20 | 7.7 | 10.6 | 6.6 | 12.0 |

*paint delamination

As can be seen from the results shown in Table 2, the conversion coatings of Example 5, including a complex metal fluoride ion and a metal salt different from the complex metal fluoride ion, but without any calcium ions, resulted in the test panels having paint delamination.

On the other hand, the conversion coatings prepared according to Examples 6–20 in accordance with the present invention, resulted in the test panels having good corrosion resistance.

Moreover, when compared with the prior art conversion coating of Examples 1 and 2, the results of Examples 6–20 demonstrate that the conversion coatings of the present invention provide improved results for paint adhesion on either one or both of cold rolled steel or electrogalvanized panels.

Example 21

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |

The compositions of Example 21 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) conditioning: the test panels were dipped into Kasil #6 solution (0.25 g/l, pH 9.8) at room temperature for 1 minute;

(d) coating: the test panels were dipped into the treatment solution, of the present example, at room temperature for 2 minutes;

(e) rinse: the test panels were rinsed with deionized water for 30 seconds;

(f) drying: the test panels were then dried with a hot air gun for approximately 10 minutes;

(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

Example 22

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |

Example 23

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |

-continued

| | | |
|---|---|---|
| 20.5 g/l | calcium nitrate | (approx. 5000 ppm Ca) |
| 2.5 g/l | ferrous sulfate, heptahydrate | (approx. 500 ppm Fe) |

The compositions of Examples 22–23 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin composition, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

Example 24

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |

Example 25

A conversion coating solution was prepared in deionized water as follows:

The following ingredients were mixed in the order listed below to provide a stable solution with a pH=1.8.

| | | |
|---|---|---|
| 1.0 g/l | Advera 401 (aluminosilicate - zeolite) | |
| 6.0 g/l | nitric acid (42 Be) | |
| 2.25 g/l | hexafluorozirconic acid | (approx. 990 ppm Zr, 1200 ppm F) |
| 20.5 g/l | calcium nitrate | (approx. 5000 ppm Ca) |

The compositions of Examples 24–25 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the treatment solution, of the present example, at room temperature for 2 minutes;

(d) rinse: the test panels were rinsed with deionized water for 30 seconds;

(e) sealer: the test panels were dipped into a non-chrome sealer rinse ("Chemseal 77" available from PPG industries, Inc. modified with 100 ppm fluoride) at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-cathodic free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

TABLE 3

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 21 | 4.0 | 10.8 | 5.6 | 15.0 |
| 22 | 1.3 | 4.5 | 11.4 | 23.2 |
| 23 | 1.0 | 3.2 | 12.9 | 29.0 |
| 24 | 1.8 | 4.8 | 13.3 | 28.8 |
| 25 | 1.1 | 3.2 | 14.3 | 34.0 |

As can be seen from the results shown in Table 3, various processing steps, such as the use of conditioners, epoxy resin coats, and sealers, during treatment and coating of the panels provides for an improvement in the corrosion resistance for one or both of cold rolled steel or electrogalvanized panels.

Example 26

A conversion coating solution was prepared in deionized water as follows:

The following ingredients were mixed in the order listed below to provide a stable solution with a pH=2.0.

| | | |
|---|---|---|
| 2.25 g/l | hexafluorozirconic acid | (approx. 990 ppm Zr, 1200 ppm F) |
| 21.0 g/l | magnesium nitrate, hexahydrate | (approx. 2000 ppm Mg) |

Example 27

A conversion coating solution was prepared in deionized water as follows:

The following ingredients were mixed in the order listed below to provide a stable solution with a pH=4.2.

| | | |
|---|---|---|
| 2.25 g/l | hexafluorozirconic acid | (approx. 990 ppm Zr, 1200 ppm F) |
| 21.0 g/l | magnesium nitrate, hexahydrate | (approx. 2000 ppm Mg) |
| | ammonium hydroxide (28%) | |

The compositions of Examples 26–27 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 4.

TABLE 4

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 26 | 3.5 | 4.5 | 11.8 | 20.3 |
| 27 | 7.4 | 11.7 | 7.4 | 11.5 |

Example 28

A conversion coating solution was prepared in deionized water as follows:

The following ingredients were mixed in the order listed below to provide a stable solution with a pH=2.0.

| | | |
|---|---|---|
| 4.05 g/l | fluoroboric acid (50%) | (approx. 2000 ppm $BF_4$) |
| 8.0 g/l | calcium nitrate | (approximately 2,000 ppm Ca) |

The composition of Example 28 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 5.

Example 29

A conversion coating solution was prepared in deionized water as follows:

The following ingredients were mixed in the order listed below to provide a stable solution with a pH=2.0.

| | | |
|---|---|---|
| 4.05 g/l | fluoroboric acid (50%) | (approx. 2000 ppm $BF_4$) |
| 8.0 g/l | calcium nitrate | (approximately 2,000 ppm Ca) |

The compositions of Example 29 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 5.

TABLE 5

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 28 | 5.6 | 8.5 | NA | NA |
| 29 | 5.4 | 12.7 | NA | NA |

Example 30

A conversion coating solution was prepared in deionized water as follows:

The following ingredients were mixed in the order listed below to provide a stable solution with a pH=2.0.

| | | |
|---|---|---|
| 1.35 g/l | zirconyl nitrate solution (14.8% Zr) | (approx. 200 ppm Zr) |
| 2.25 g/l | hexafluorozirconic acid | (approx. 990 ppm Zr, 1200 ppm F) |
| 8.0 g/l | calcium nitrate | (approximately 2,000 ppm Ca) |

Example 31

A conversion coating solution was prepared in deionized water as follows:

The following ingredients were mixed in the order listed below to provide a stable solution with a pH=2.5.

| | | |
|---|---|---|
| 6.7 g/l | zirconyl nitrate solution (14.8% Zr) | (approx. 1000 ppm Zr) |
| 1.25 g/l | ammonium bifluoride (s) | (approx. 840 ppm F) |
| 8.0 g/l | calcium nitrate | (approximately 2,000 ppm Ca) |

Example 32

A conversion coating solution was prepared in deionized water as follows:

The following ingredients were mixed in the order listed below to provide a stable solution with a pH=2.5.

| | | |
|---|---|---|
| 6.7 g/l | zirconyl nitrate solution (14.8% Zr) | (approx. 1000 ppm Zr) |
| 1.25 g/l | ammonium bifluoride (s) | (approx. 840 ppm F) |
| 8.0 g/l | calcium nitrate | (approximately 2,000 ppm Ca) |

The compositions of Examples 30–32 were used as conversion coatings for treating cold rolled steel and electro-galvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 6.

TABLE 6

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 30 | 2.3 | 6.3 | 18.9 | 29.0 |
| 31 | 4.5 | 6.5 | NA | NA |
| 32 | 4.9 | 5.9 | NA | NA |

Example 33

A conversion coating solution was prepared in deionized water as follows:

The following ingredients were mixed in the order listed below to provide a stable solution with a pH=2.3.

| | | |
|---|---|---|
| 2.0 g/l | hexafluorosilicic acid | (approx. 400 ppm Si and 1600 ppm F) |
| 6.12 g/l | calcium nitrate | (approx. 1500 ppm Ca) |

Example 34

A conversion coating solution was prepared in deionized water as follows:

The following ingredients were mixed in the order listed below to provide a stable solution with a pH=2.0.

| | | |
|---|---|---|
| 10.0 g/l | hexafluorosilicic acid | (approx. 1900 ppm Si and 7900 ppm F) |
| 20.5 g/l | calcium nitrate | (approx. 5000 ppm Ca) |

Example 35

A conversion coating solution was prepared in deionized water as follows:

The following ingredients were mixed in the order listed below to provide a stable solution with a pH=1.4.

| | | |
|---|---|---|
| 4.0 g/l | hexafluorosilicic acid | (approx. 800 ppm Si and 3200 ppm F) |
| 16.4 g/l | calcium nitrate | (approx. 4000 ppm Ca) |
| 0.25 g/l | Advera 401 (aluminosilicate - zeolite added as stabilizer) | |

Example 36

A conversion coating solution was prepared in deionized water as follows:

The following ingredients were mixed in the order listed below to provide a stable solution with a pH=1.7.

| | | |
|---|---|---|
| 4.0 g/l | hexafluorosilicic acid | (approx. 800 ppm Si and 3200 ppm F) |
| 32.8 g/l | calcium nitrate | (approx. 8000 ppm Ca) |
| 0.25 g/l | Advera 401 (aluminosilicate - zeolite added as stabilizer) | |

The compositions of Examples 33–36 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15–30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 7.

TABLE 7

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 33 | 11.8 | 20.1 | 6.4 | 8.5 |
| 34 | 5.0 | 7.1 | 7.3 | 13.4 |
| 35 | 7.6 | 19.0 | 7.2 | 15.6 |
| 36 | 7.5 | 15.3 | 3.7 | 11.2 |

As can be seen from the above examples, the conversion coatings of the present invention provide corrosion resistance equal to or better than prior art conversion coatings.

While the invention has been described in terms of preferred embodiments, it is to be understood that various modifications thereof will become apparent to those skilled in the art upon reading the specification. Therefore, it is to be understood that the invention disclosed herein is intended to encompass such modifications as fall within the scope of the appended claims.

What is claimed is:

1. An aqueous composition for pretreating and depositing a crystalline coating on metal substrates comprising:

a) from about 1,500 to about 55,000 ppm based on the aqueous composition, of a Group IIA dissolved metal ion;

b) from about 100 to about 200,000 ppm based on the aqueous composition, of a dissolved complex metal fluoride ion wherein the metal atom is selected from Group IIIA, Group IVA, Group IVB, Group VA, and Group VB metals;

c) a complex forming metal salt different from the complex metal fluoride ion, wherein the complex forming metal salt is selected from the group consisting of sodium metasilicate, polysilicate, Zeolites (aluminosilicates), zirconyl nitrate, titanyl sulfate, tetrafluorozirconate, tetrafluorotitanate; and d) water, wherein the composition is substantially free of Group IIA metal fluoride precipitate.

2. An aqueous composition as in claim 1, additionally containing ferrous ions, ferric ions, and/or zinc ions in a range of about 10–2,000 ppm.

3. An aqueous composition as in claim 1, wherein said Group IIA dissolved metal ion is selected from the group consisting of calcium, magnesium, beryllium, strontium, and barium.

4. An aqueous composition as in claim 3, wherein said Group IIA dissolved metal ion is calcium.

5. An aqueous composition as in claim 1, wherein the metal atom of said complex metal fluoride ion is selected from the group consisting of silicon, zirconium, and titanium.

6. An aqueous composition as in claim 5, wherein said complex metal fluoride ion is selected from the group consisting of hexafluorosilicate, hexafluorozirconate, and hexafluorotitanate.

7. An aqueous composition as in claim 1, wherein said Group IIA dissolved metal ion is provided in an amount of from about 2,000 to about 10,000 ppm.

8. An aqueous composition as in claim 1, wherein said dissolved complex metal fluoride ion is provided in an amount of from about 1,000 to about 80,000 ppm.

9. An aqueous composition as in claim 1, wherein said composition has a pH of from about 0.0 to about 5.0.

* * * * *